US007082881B2

(12) United States Patent
Schneider et al.

(10) Patent No.: US 7,082,881 B2
(45) Date of Patent: Aug. 1, 2006

(54) MOUNT APPARATUS FOR MOUNTING A MEASUREMENT DEVICE ON A RAIL CAR

(75) Inventors: Chad Schneider, Annandale, VA (US); Jeffrey Bloom, Silver Spring, MD (US); Gary A. Carr, Fairfax, VA (US)

(73) Assignee: Ensco, Inc., Falls Church, VA (US)

( * ) Notice: Subject to any disclaimer, the term of this patent is extended or adjusted under 35 U.S.C. 154(b) by 0 days.

(21) Appl. No.: 10/764,493

(22) Filed: Jan. 27, 2004

(65) Prior Publication Data

US 2004/0244637 A1 Dec. 9, 2004

Related U.S. Application Data

(60) Provisional application No. 60/442,537, filed on Jan. 27, 2003.

(51) Int. Cl.
*B61D 1/00* (2006.01)

(52) U.S. Cl. ..... 105/157.1; 105/218.1

(58) Field of Classification Search ..... 105/157.1, 105/178, 165, 182.1, 218.1, 218.2
See application file for complete search history.

(56) References Cited

U.S. PATENT DOCUMENTS 3,857,183 A * 12/1974 Plasser et al. ..... 33/523
4,067,261 A 1/1978 Scheffel
4,356,775 A 11/1982 Paton et al.
4,385,857 A 5/1983 Willetts
4,445,439 A 5/1984 Tilly et al.
4,561,360 A 12/1985 Mulcahy
4,589,346 A 5/1986 Miller
4,637,318 A 1/1987 Paton
5,001,989 A 3/1991 Mulcahy et al.
5,203,089 A * 4/1993 Trefouel et al. ..... 33/338
5,479,863 A 1/1996 Ahlborn et al.
6,725,782 B1 * 4/2004 Bloom et al. ..... 105/27

FOREIGN PATENT DOCUMENTS

EP 0571961 A1 12/1993
GB 2132712 A 7/1984

* cited by examiner

*Primary Examiner*—S. Joseph Morano
*Assistant Examiner*—Robert J. McCarry, Jr.
(74) *Attorney, Agent, or Firm*—Nixon Peabody LLP; Jeffrey L. Costellia

(57) ABSTRACT

A mount apparatus for mounting a measurement device on a rail car above a track surface of a railroad track including a securement member adapted to be secured to the unsprung component of the rail car, a pivot arm pivotably connected to the securement member, the pivot arm including a lever arm extending therefrom, and a swing arm connecting the lever arm of the pivot arm to the sprung component of the rail car. The swing arm rotates the pivot arm so that a distal end of the pivot arm is maintained at a substantially fixed height distance above the track surface.

21 Claims, 5 Drawing Sheets

MOUNT APPARATUS FOR MOUNTING A MEASUREMENT DEVICE ON A RAIL CAR

This application claims priority to U.S. Provisional Application No. 60/442,537, filed Jan. 27, 2003, the contents of which are incorporated herein by reference.

BACKGROUND OF THE INVENTION

1. Field of the Invention

The present invention is directed to a mount apparatus for mounting a measurement device on a rail car. In particular, the present invention is directed to a mount apparatus that is movably secured to a rail car which maintains a substantially fixed vertical position relative to the track surface of a railroad track.

2. Description of Related Art

Various types of rail cars with different types of axle suspension systems are known and used in the railroad transportation industry for rail cars of freight and passenger trains. Axle suspension systems serve an important function in that they suspend and stabilize the rail cars by allowing the wheels of the rail cars to move relative to the frame of the rail car body. Thus, the axle suspension systems allow wheels of the rail car to absorb impact which occurs as the wheels roll along the track surface of the railroad track. The axle suspension systems also allow isolation of the rail car to provide a more comfortable ride to passengers of passenger rail cars having axle suspension systems.

Generally axle suspension systems include trucks having axles with wheels attached thereto. The axles are typically mounted to the truck via axle bearing housings, suspension links which locate the axle bearing housings, and springs which suspends the truck over the axles. The rail car body is secured over the truck, with or without other suspension components between the rail car body and the frame of the truck. Thus, the wheels, the axles, and the axle bearing housings are unsprung components of the axle suspension system whereas the truck frame of the axle suspension component is a sprung component.

U.S. Pat. No. 4,356,775 to Paton et al. shows one example of a dampened railway car suspension including a movable load arm assembly for supporting a rail car axle. The load arm assembly to which the axle is attached is movable relative to the truck and thus, is movable relative to the rail car itself. Such movable load arm assemblies allow use of springs and dampeners to absorb impact which occurs as the wheels roll along the track surface of the railroad track. By providing such suspension, the wheels of the rail cars are better controlled and the ride quality of the rail cars is improved as previously noted.

U.S. Pat. No. 5,001,989 to Mulcahy et al. shows another example of a single axle suspension system for rail car truck. Mulcahy et al. discloses a single axle railway truck having an axle box with spring support for suspending the frame of the rail car. The suspension system disclosed in Mulcahy et al. also includes a lateral traction rod which is supported by the single axle and secured to the side frame of the rail car, the lateral traction rod being a component of the suspension system.

Further, rail condition is a very important aspect of rail transit safety. Any damage or defects in the track surface, the railroad track alignment, and other rail parameters can cause derailment of the rail car which will result in significant property damage and possible injury to the train operators, passengers, and bystanders. Consequently, continual inspections are made to ensure that the railroad tracks are in good condition so that chances of derailment are minimized.

In the above regard, measurement devices such as electronic sensors and other mechanical/electro-mechanical devices are now being used in various ways to monitor the condition of the railroad tracks and the track surface. Such sensors and other measurement devices utilize laser, optical, magnetic, or other mechanical/electromechanical technologies to measure various parameters of the track surface and alignment of the railroad track so that the condition of the track surface and the railroad track can be monitored.

SUMMARY OF THE INVENTION

Mounting of measurement devices such as electronic sensors and other such devices for monitoring track conditions is a significant limitation in obtaining accurate data and information regarding the railroad track and the track surface. This limitation is due to the fact that such measurement devices are typically attached to the truck frame or the rail car frame, proximate to the railroad track. Because both the truck frame and the rail car frame are sprung components which are suspended by an axle suspension system, such as those previously described, these components correspondingly move vertically relative to the railroad track and the track surface with the rail car as it moves along the railroad track. As a result, the vertical position of the measurement devices relative to the railroad track varies significantly as the rail car moves along the railroad track. This impedes obtaining of meaningful data and information regarding the condition of the railroad track, such as dimensional parameters of the track surface and/or the railroad track alignment.

To compensate for the variation in the vertical position of the measurement devices, measurement range may be increased if the measurement devices allows such an increase. This typically results in lower measurement resolution and accuracy. However, providing high resolution is desirable when measuring various parameters such as rail corrugation and condition, track surface, track alignment, and the like. Consequently, effective monitoring of the railroad track condition and track surface for damage or defects cannot be readily attained using presently available methods or devices for mounting such measurement devices.

In view of the foregoing, one aspect of the present invention is providing a mount apparatus for mounting measurement devices on a rail car.

One advantage of the present invention is in providing such a mount apparatus that maintains a substantially fixed vertical position relative to the track surface of a railroad track.

Still another advantage of the present invention is in providing such a mount apparatus which is mounted to an axle bearing housing of a rail car truck.

In accordance with one aspect of the present invention, a mount apparatus for mounting a measurement device on a rail car above a track surface of a railroad track is provided, the rail car having an unsprung component and a sprung component. The mount apparatus comprises a securement member adapted to be secured to the unsprung component of the rail car, a pivot arm pivotably connected to the securement member, the pivot arm including a lever arm extending therefrom, and a swing arm connecting the lever arm of the pivot arm to the sprung component of the rail car. The swing arm rotates the pivot arm so that a distal end of the pivot arm is maintained at a substantially fixed height distance above the track surface.

In accordance with one embodiment, the securement member is implemented as a cradle member which is adapted to be secured to an axle bearing housing of a rail car truck, the cradle member including a semi-circular axle bearing housing portion. In another embodiment, one end of the pivot arm is pivotably connected to the securement member by a bearing, and the distal end of the pivot arm is provided with a cross bar mount for mounting a cross bar that laterally extends above the track surface.

In accordance with other embodiments of the present invention, the lever arm of the pivot arm may be implemented as an extension flange. The swing arm may be connected to a truck frame and be implemented to allow adjustment to the length of the swing arm. For example, the swing arm may include a threaded stud member and one reverse threaded end that allows adjustment to its length.

In accordance with yet another embodiment of the present invention, a mount apparatus for mounting a measurement device on a rail car above a track surface of a railroad track is provided, the mount apparatus comprising a securement member adapted to be secured to the unsprung component of the rail car, a pivot arm pivotably connected to the securement member and having a lever arm extending therefrom, and a swing arm connecting the lever arm of the pivot arm to the sprung component of the rail car. The swing arm rotates the pivot arm in a manner to move a distal end of the pivot arm a vertical distance that offsets a vertical distance moved by the sprung component relative to the unsprung component.

In accordance with still another aspect of the present invention, a method for mounting a measurement device on a rail car is provided, the method comprising the steps of securing the measurement device above a track surface of a railroad track, and moving the position of the measurement device in response to movement of the sprung component relative to the unsprung component, thereby maintaining position of the measurement device at a substantially the same fixed height distance above the track surface.

In accordance with another embodiment, the method may further include the steps of securing the measurement device to a mounting apparatus, and moving the position of the mounting apparatus in response to movement of the sprung component relative to the track surface, thereby moving the position of the measurement device. In one implementation, the mounting apparatus may include a securement member, a pivot arm with a lever arm extending therefrom, and a swing arm. In this regard, the method may further include the steps of securing the securement member to the unsprung component of the rail car, connecting the pivot arm to the securement member, and connecting the swing arm to the lever arm of the pivot arm and to the sprung component of the rail car. Thus, the pivot arm is rotated to move a distal end of the pivot arm a vertical distance that offsets a vertical distance moved by the sprung component relative to the track surface. Moreover, in accordance with another embodiment, the method may further include the step of adjusting the position of a distal end of the pivot arm based on an output of the measurement device.

These and other features of the present invention will become more apparent from the following detailed description of the preferred embodiments of the present invention when viewed in conjunction with the accompanying drawings.

DETAILED DESCRIPTION OF THE PREFERRED EMBODIMENT

Figure 1:
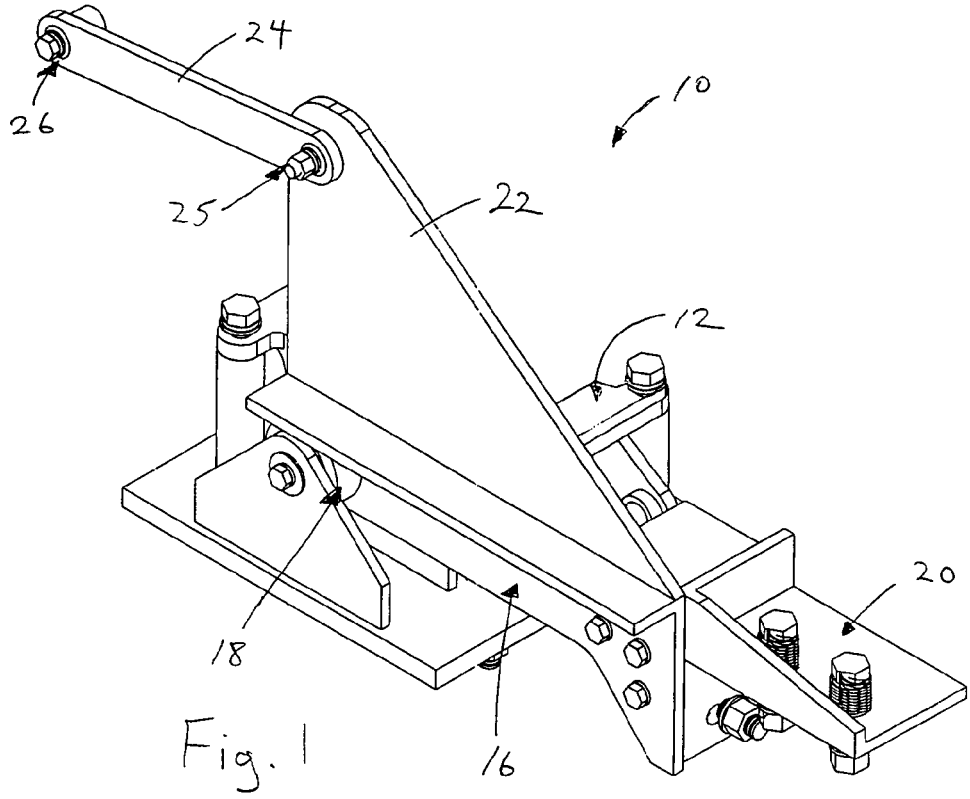
FIG. 1 is a perspective view of a mount apparatus for mounting a measurement device on a rail car in accordance with one embodiment of the present invention.
Figure 2:
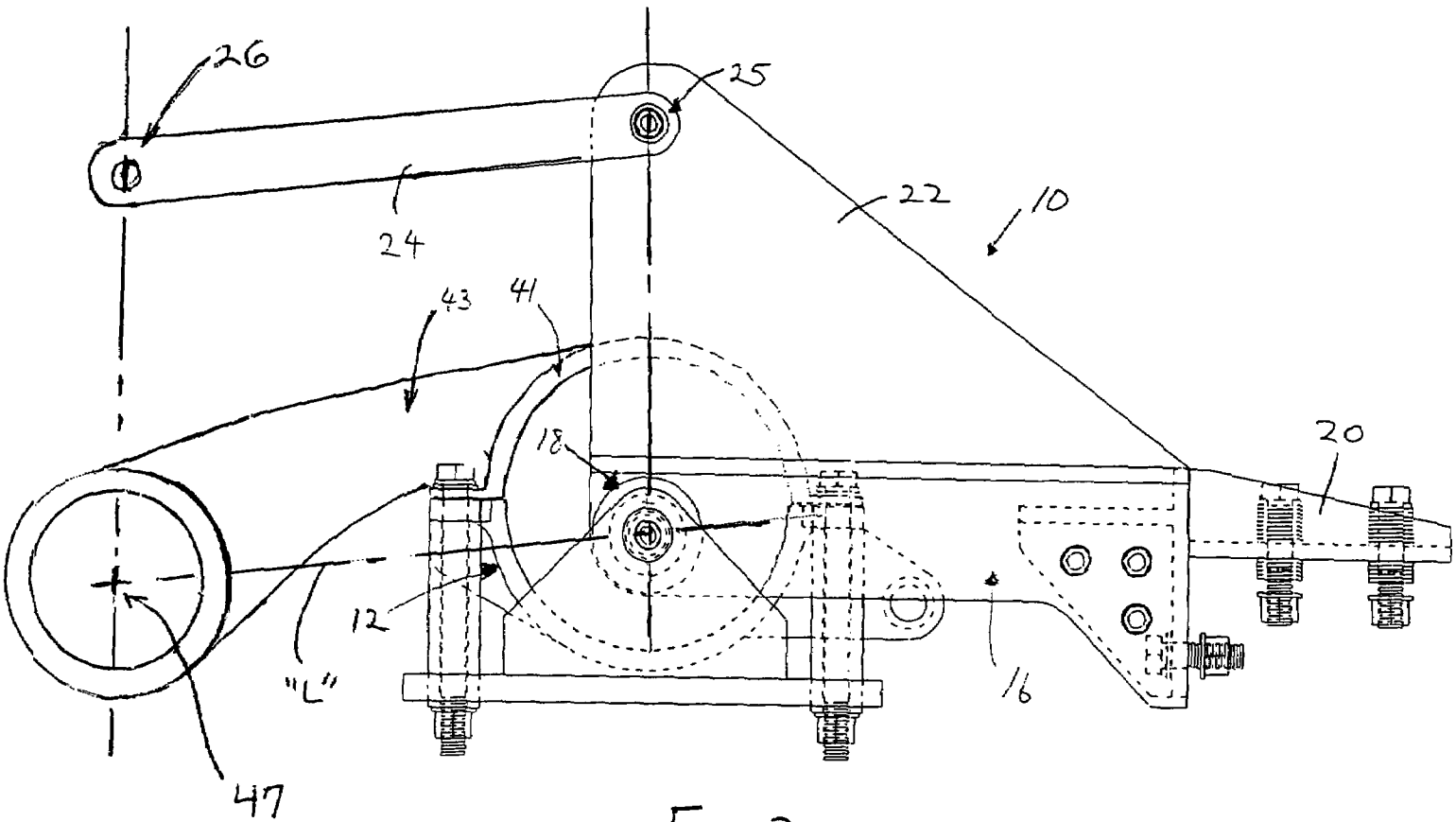
FIG. 2 is a side profile view of the mount apparatus of FIG. 1 mounted to an axle bearing housing of a rail car truck.

FIGS. 1 and 2 illustrate various views of a mount apparatus 10 for mounting one or more measurement devices such as electronic sensors or other mechanical/electro-mechanical devices on a rail car in accordance with one embodiment of the present invention. As explained in further detail below, the mount apparatus 10 is adapted to be movably secured to the rail car so that a distal end of the mount apparatus 10 maintains a substantially fixed vertical position relative to the track surface of a railroad track. This allows measurement devices such as electronic sensors and other devices that may utilize laser, optical, magnetic, or other technologies, to be readily mounted in the manner further described below for monitoring track surface, railroad track alignment, and/or other parameters.

Figure 3:
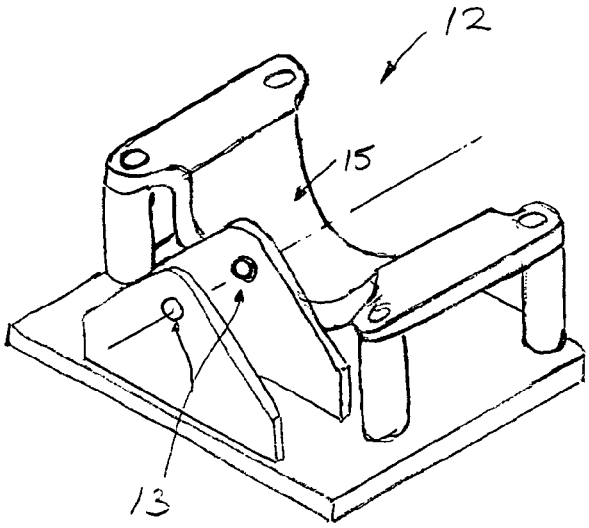
FIG. 3 shows a perspective view of a cradle member in accordance with one embodiment of the present invention.

Referring to FIGS. 1 to 3, the mount apparatus 10 includes a securement member that allows the mount apparatus 10 to be mounted to an unsprung component of a rail car (not shown). In the illustrated embodiment, the securement member is implemented as a cradle member 12 which is most clearly shown in FIG. 3. As shown in FIG. 2, the axle bearing housing 41 is adapted to support an axle of the rail car about which the wheels of the rail car rotate to move the rail car along the railroad track. The cradle member 12 is provided with a substantially semi-circular axle bearing receiving portion 15 that allows the mount apparatus 10 to be secured to axle bearing housing 41 with the axle bearing (not shown) disposed therein. As previously described, the axle bearing housing 41 is an unsprung component of the truck of the rail car. The axle bearing housing 41 is attached to suspension link 43 which is pivotably secured to the frame of the rail car truck at pivot 47. This allows the truck frame and the axle to move relative to each other, the truck frame being a sprung component of the rail car truck.

The mount apparatus 10 in accordance with the illustrated embodiment also includes a pivot arm 16 that is pivotably secured to the mount 13 of the cradle member 12. In this regard, one end of the pivot arm 16 is supported on a bearing 18 at one end via the mounts 13 thereby allowing the pivot arm 16 to pivot relative to the cradle member 12, the distal end of the pivot arm 16 being cantilevered as shown. In the illustrated embodiment of FIGS. 1 and 2, the mount apparatus 10 also includes a cross bar mount 20 provided at the distal end of the pivot arm 16, the cross bar mount 20 being adapted to secure a cross bar (not shown) that may be used to mount one or more measurement devices for measuring parameters of the railroad track. Of course, in other embodiments, the measurement devices may be directly mounted to the pivot arm 16 instead of a cross bar.

The pivot arm 16 of the illustrated embodiment is further provided with an extension flange 22 which extends from the pivot arm 16 and acts as a lever arm for rotating the pivot arm 16 relative to the cradle member 12 in a manner described herein. The mount apparatus 10 is further provided with a swing arm 24 which, in the present embodiment, is substantially parallel to line "L" extending between the pivot 47 and the mount 13 of the cradle member 12 as shown in FIG. 2. One end 25 of the swing arm 24 is hingably attached to the extension flange 22 at a position which is a predetermined distance from the pivot arm 16. The other end 26 of the swing arm 24 is attached to a sprung component of the rail car, for example, the truck frame, at a point above the pivot 47. Thus, a substantially parallel linkage structure is formed between the swing arm 24 and the suspension link 43. Because the swing arm 24 is attached to extension flange 22 at a distance from the pivot arm 16, the pivot arm 16 may be pivoted about the bearing 18 by rotation and/or displacement of the swing arm 24. Consequently, any movement of the rail car truck relative to the axle bearing housing 41, or vice versa, causes corresponding rotation and/or displacement of the swing arm 24.

Figure 4:
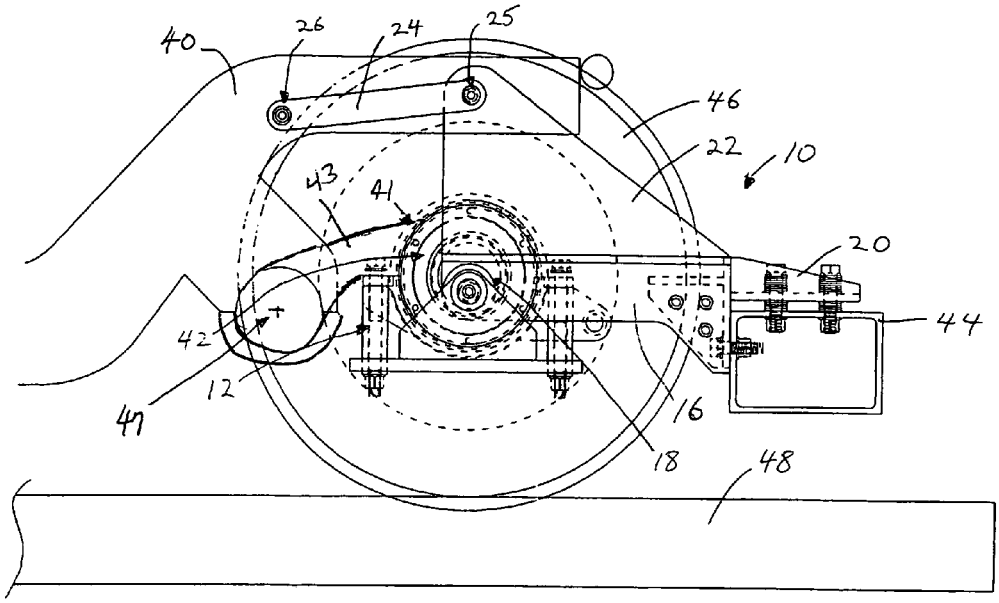
FIG. 4 is a partial schematic side profile view of the mount apparatus of FIG. 1 which is installed on an axle bearing housing of a rail car truck.

The mounting and use of the mount apparatus 110 is more clearly shown in FIG. 4. As shown, the mount apparatus 10 is secured to an unsprung component of the rail car such as the axle bearing housing 41 using a securement member, which in the present embodiment, is implemented as the cradle member 12. A spring and a damper may be mounted between the truck frame 40 and the axle bearing housing 41 like conventional rail car trucks, these components being omitted in FIG. 4 for clarity purposes.

As previously described, the pivot arm 16 is pivotable relative to the cradle member 12, the positioning of the pivot arm 16 being controlled by the swing arm 24 via the extension flange 22 in the present embodiment. In particular, as the wheel 46 rotates about the axle 42 along the rail 48 of a railroad track, there is relative movement between the sprung component and the unsprung component, i.e. the truck frame 40 and the axle 42. The movement may be caused by irregularities on the surface of the track and/or wheel 46. Such relative movement may also be caused by objects on the track surface, or by the dynamic loading of the rail car body which can cause the rail car body and/or truck frame 40 to pitch or roll. The movement of the truck frame 40 relative to the axle bearing housing 41, or vice versa, causes the swing arm 24 to exert a displacing force to the extension flange 22 of the pivot arm 16 thereby causing the pivot arm 16 to rotate about the bearing 18 so that the distal end of the pivot arm 16 moves to compensate for the relative movement.

In particular, as evident from careful examination of FIG. 4, the pivot arm 16 rotates counter clockwise about the bearing 18, away from the rail 48, if the truck frame 40 is displaced downward toward the rail 48. Likewise, the pivot arm 16 rotates clockwise about the bearing 18, toward the rail 48, if the truck frame 40 is displaced upward away from the rail 48. Thus, the mount apparatus 10 in accordance with the present invention automatically rotates the pivot arm 16 in response to movement of the truck frame 40 relative to the axle 42.

In the preferred embodiment, the various components of the mount apparatus 10 are dimensioned so that the pivot arm 16 is rotated about the bearing 18 so that the distal end of the pivot arm 16 at which the cross bar mount 20 is provided, maintains a substantially fixed height distance above the track surface of rail 48. In other words, the pivot arm 16 is rotated so that the cross bar mount 20 is moved a vertical distance which offsets the vertical distance moved by the truck frame 40 relative to the axle 42 thereby compensating for the relative movement. FIG. 4 also shows one embodiment of a cross bar 44 that is secured to the cross bar mount 20 for providing easy mounting of one or more measurement devices such as electronic sensors and/or other mechanical/electro-mechanical devices for measuring various parameters of the rail 48. Thus, in the illustrated embodiment where the cross bar 44 is secured to the cross bar mount 20, the cross bar 44 maintains a substantially fixed height distance from the track surface of the rail 48.

It should be noted that the lever arm in the illustrated embodiment is implemented as the extension flange 22 to minimize stresses exerted thereon by the swing arm 24 to ensure durability of the mount apparatus 10. Of course, the lever arm may be implemented as a conventional straight lever, or in any other appropriate manner. It should also be noted that whereas the swing arm 24 and the suspension link 43 are substantially parallel and of substantially equal length in the illustrated implementation, other geometries/dimensions may be used in other implementations as well. In addition, whereas FIG. 4 merely illustrates one mount apparatus 10 mounted to one end of the axle 42, in operation, another mount apparatus may be provided and mounted to the other end of the axle 42 at the other side of the rail car. This allows the cross bar 44 to extend across the width of the railroad track over both of the rails of the railroad track (only one rail being shown), and further allows the cross bar 44 to be supported on both ends of the axle 42 so as to reduce vibrations and/or oscillations thereof.

By providing a mount apparatus 10 which maintains a substantially fixed vertical position at the cross bar mount 20 from the track surface of a railroad track, the disadvantages and limitations of the prior art mounting methods can be readily minimized. Thus, the present invention allows measurement devices such as sensors and other mechanical/electro-mechanical devices to be readily mounted to the rail car for monitoring and measuring parameters associated with the track surface, railroad track alignment, etc.

Figure 5:
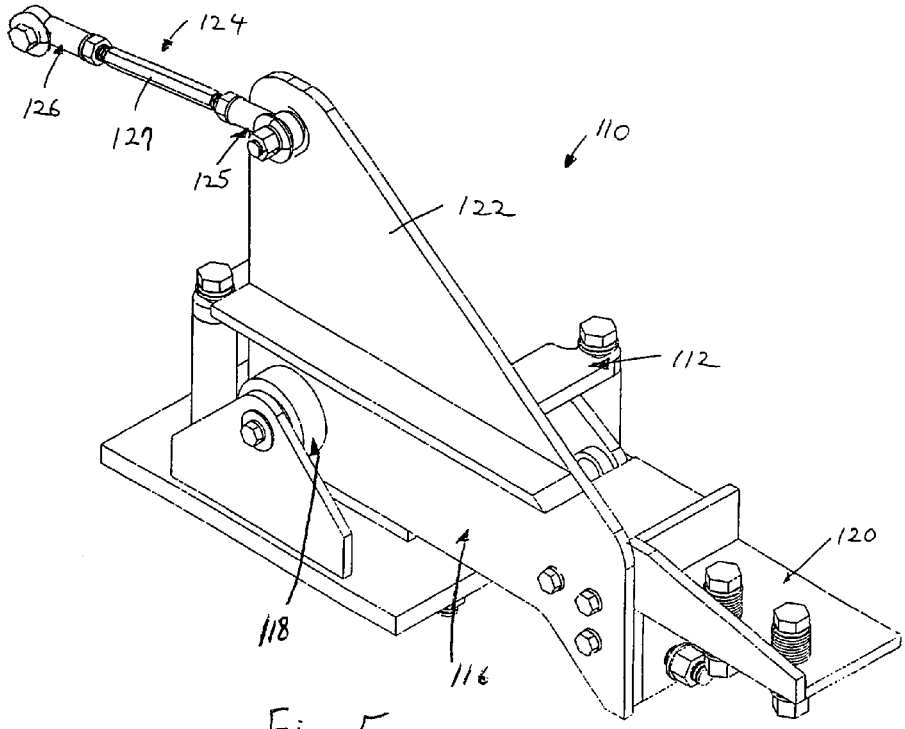
FIG. 5 is a perspective view of a mount apparatus for mounting a measurement device on a rail car in accordance with another embodiment of the present invention.

FIG. 5 is a perspective view of a mount apparatus 110 for mounting measurement devices such as sensors and the like on a rail car in accordance with another embodiment of the present invention. As can be appreciated, the mount apparatus 110 is substantially similar to the mount apparatus 10 described above relative to FIGS. 1 to 4. In this regard, the mount apparatus 110 of FIG. 5 includes a cradle member 112 that allows the mount apparatus 110 to be secured to an unsprung component of the rail car such as an axle bearing housing. A pivot arm 116 is secured to the cradle member 112 and is supported on a bearing 118 that allows the pivot arm 116 to pivot relative to the cradle member 112. A cross bar mount 120 is provided at the distal end of the pivot arm 116 to secure a cross bar 144 that may be used to mount one or more measurement devices.

The pivot arm 116 is further provided with an extension flange 122 that acts as a lever arm in the manner previously described. The positioning of the pivot arm 116 is controlled by the swing arm 124 via the extension flange 122, the swing arm 124 being connected to a sprung component of the rail car such as the truck frame 140. Thus, when there is relative movement between the truck frame 140 and the axle bearing housing to which the mount apparatus 110 is mounted, the swing arm 124 compensates for the relative movement by pivoting the pivot arm 116 about the bearing 118.

In accordance with the illustrated embodiment of FIG. 5, the swing arm 124 is also made so that its length is adjustable. As shown, the end 125 of the swing arm 124 that is hingably attached to the extension flange 122 is threaded to a stud member 127 so that the position of the end 125 relative to the stud member 127 may be adjusted. Likewise, the other end 126 of the swing arm 124 which is attached to the truck frame of the rail car, is also threaded to the stud member 127 so that the position of the end 126 relative to the stud member 127 may be adjusted. Preferably, one of the ends is reverse threaded so that positions of both ends 125 and 126 can be simultaneously adjusted by rotating the stud member 127. Thus, by adjusting the position of end 125 and/or end 126 on the stud member 127, the length of the swing arm 124 can be readily adjusted.

This adjustability of the swing arm 124 allows the initial position of the pivot arm 116 to be adjusted so that the position of the measurement devices, such as sensors that are secured to the distal end of the pivot arm 116, can be adjusted as well. This allows accurate measurements to be attained because the measurement devices can be initially positioned to optimize their accuracy and sensitivity and moved to maintain this optimal position over the track surface. In addition, the measurement devices themselves can be used to facilitate proper adjustment of the swing arm 124. For example by monitoring output or measurement readings of the measurement devices while adjusting the length of the swing arm 124, the optimal positioning of the pivot arm 116, and thus, the measurement devices may be obtained. Of course, in other embodiments, the adjustability of the swing arm 124 may be actively controlled so that the height adjustment may be finely tuned, for example, by using the output of the measurement device, or using a computational device.

Figure 6:
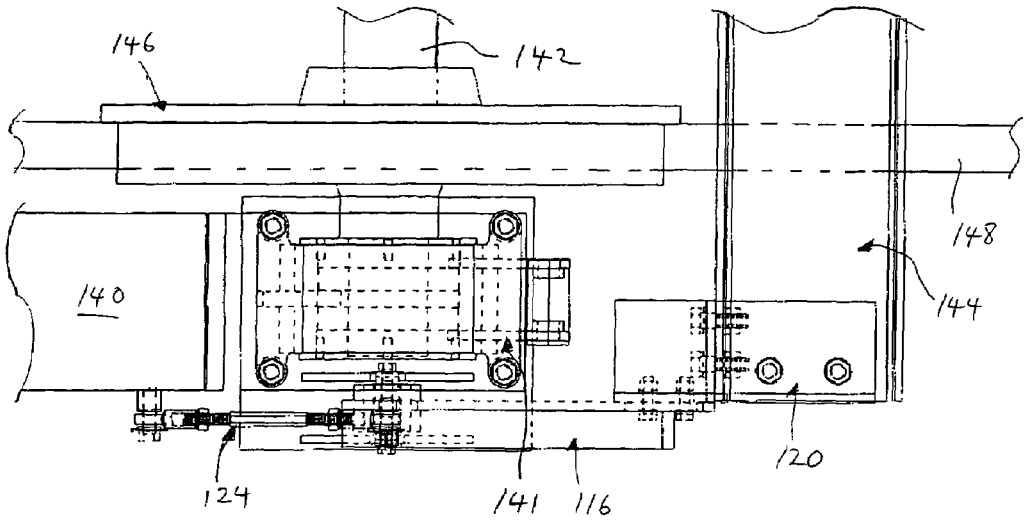
FIG. 6 is a partial schematic top view of the mount apparatus of FIG. 5 which is installed on an axle bearing housing of a rail car truck.

FIG. 6 is a partial schematic top view of the mount apparatus 110 of FIG. 5 shown installed on an axle bearing housing 141 of a rail car. The suspension link is omitted in FIG. 6 to enhance clarity. As shown and already described relative to the other embodiment, the pivot arm 116 is mounted so that it is pivoted by the swing arm 124 to compensate for the relative movement between the truck frame 140 and the axle 142, and correspondingly, between the truck frame 140 and the track surface 148. In addition, FIG. 6 clearly illustrates the cross bar 144 which is attached to cross bar mount 120 that allows easy mounting of electronic sensors and/or mechanical/electromechanical devices for measuring various parameters of the rail 148.

Figure 7:
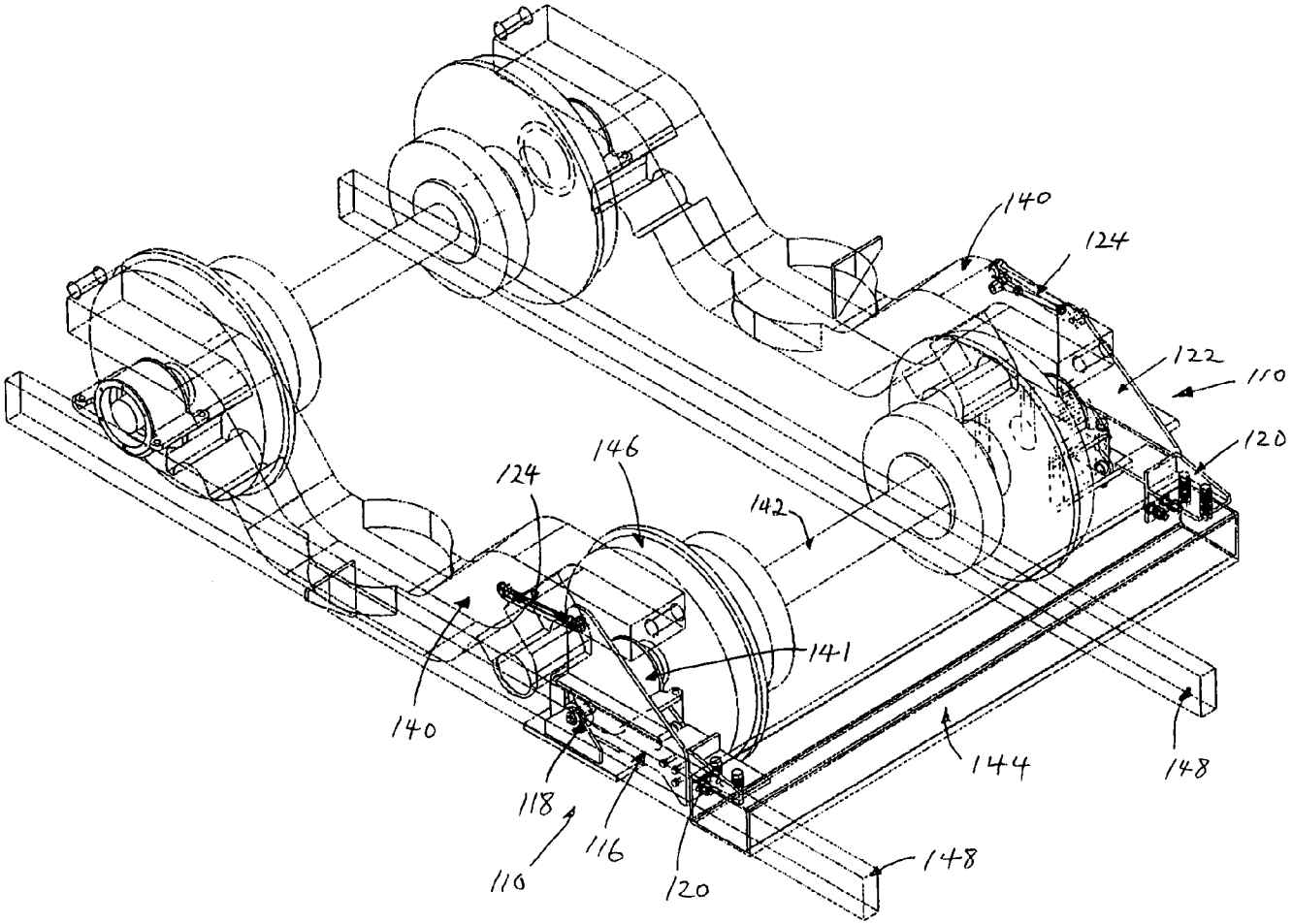
FIG. 7 is a schematic perspective view of the mount apparatus of FIG. 5 mounted on a rail car truck.

FIG. 7 is a schematic perspective view of the mount apparatus 110 of FIGS. 5 and 6 which also shows the structure of the truck frame 140 and how the mount apparatus 110 functions. In addition, FIG. 7 also shows a second mount apparatus provided and mounted to the other end of the axle 142 so as to allow the cross bar 144 to extend across the width of the railroad track and be supported on both ends of the axle 142. This allows easy mounting of one or more measurement devices such as electronic sensors and/or mechanical/electro-mechanical devices for measuring various parameters of the rail 148 and the railroad track. It should be evident that the position of the cross bar 144 can be readily adjusted by adjusting the length of the swing arm 124 in the manner previously described.

In view of the above, it should further be evident that the present invention also provides a method for mounting one or more measurement devices on a rail car where the rail car includes a rail car truck with an unsprung component such as an axle, and a sprung component such as a truck frame. In particular, the method includes the steps of securing a measurement device above a track surface of a railroad track, and moving the position of the measurement device in response to movement of the sprung component relative to the track surface. Thus, the method, as described, maintains the position of the measurement device at substantially the same fixed height distance above the track surface and compensates for the movement of the sprung component.

More specifically, in accordance with one preferred embodiment, the method further includes the steps of securing the measurement device to a mounting apparatus, and moving the position of the mounting apparatus in response to movement of the sprung component of the rail car relative to the unsprung component, thereby moving the position of the measurement device. In another embodiment, the mounting apparatus includes a securement member, a pivot arm with a lever arm extending therefrom, and a swing arm. In such an embodiment, the method further includes the steps of securing the securement member to the unsprung component of the rail car, connecting the pivot arm to the securement member, and connecting the swing arm to the lever arm of the pivot arm and to the sprung component of the rail car. This causes the pivot arm to rotate in response to the relative movement so that a distal end of the pivot arm is moved a vertical distance that offsets the vertical distance moved by the sprung component relative to the track surface. Moreover, the method may also include the step of adjusting the position of the distal end of the pivot arm using the measurement device.

While various embodiments in accordance with the present invention have been shown and described, it is understood that the invention is not limited thereto. The present invention may be changed, modified and further applied by those skilled in the art. For example, whereas in the illustrated embodiments discussed above, the mount apparatus was provided with a cradle member that is secured to an axle bearing housing, it may also be secured to another component of the rail car such as another part of the suspension link. In addition, where the lever arm is preferably implemented as a flange member, an elongated member that extends from the pivot arm may be used instead. Therefore, this invention is not limited to the detail shown and described previously, but also includes all such changes and modifications.

The invention claimed is:

1. A mount apparatus for mounting a measurement device on a rail car above a track surface of a railroad track, the rail car having an unsprung component and a sprung component, said mount apparatus comprising:

a securement member adapted to be secured to the unsprung component of the rail car;

a pivot arm pivotably connected to said securement member, said pivot arm including a lever arm and a distal end that is cantilevered above the track surface of the railroad track; and a swing arm connecting said lever arm of said pivot arm to the sprung component of the rail car, said swing arm being adapted to rotate said pivot arm so that said distal end of said pivot arm is maintained at a substantially fixed height distance above the track surface.

2. The mount apparatus of claim 1, wherein said securement member is a cradle member adapted to be secured to an axle bearing housing of a rail car truck.

3. The mount apparatus of claim 2, wherein said cradle member includes a semi-circular axle bearing housing portion.

4. The mount apparatus of claim 1, wherein one end of said pivot arm is pivotably connected to said securement member by a bearing.

5. The mount apparatus of claim 1, wherein said lever arm of said pivot arm is an extension flange.

6. The mount apparatus of claim 1, wherein said swing arm is connected to a truck frame.

7. The mount apparatus of claim 1, wherein length dimension of said swing arm is adjustable.

8. The mount apparatus of claim 7, wherein said swing arm includes a threaded stud member and one reverse threaded end.

9. The mount apparatus of claim 1, wherein said measurement device is an electronic sensor.

10. A mount apparatus for mounting a measurement device on a rail car above a track surface of a railroad track, the rail car having an unsprung component and a sprung component, said mount apparatus comprising:

a securement member adapted to be secured to the unsprung component of the rail car;

a pivot arm pivotably connected to said securement member, said pivot arm including a lever arm and a distal end that is cantilevered above the track surface of the railroad track; and a swing arm connecting said lever arm of said pivot arm to the sprung component of the rail car, said swing arm being adapted to rotate said pivot arm so that said distal end of said pivot arm is maintained at a substantially fixed height distance above the track surface;

wherein one end of said pivot arm is pivotably connected to said securement member by a bearing;

wherein said distal end of said pivot arm is provided with a cross bar mount.

11. The mount apparatus of claim 10, further comprising a cross bar laterally extending above said track surface, said cross bar being mounted to said cross bar mount.

12. A mount apparatus for mounting a measurement device on a rail car above a track surface of a railroad track, the rail car having an unsprung component and a sprung component, said mount apparatus comprising:

a securement member adapted to be secured to the unsprung component of the rail car;

a pivot arm pivotably connected to said securement member, said pivot arm including a lever arm and a distal end that is cantilevered above the track surface of the railroad track; and a swing arm connecting said lever arm of said pivot arm to the sprung component of the rail car to rotate said pivot arm in a manner to move said distal end of said pivot arm a vertical distance that offsets a vertical distance moved by said sprung component relative to the unsprung component.

13. The mount apparatus of claim 12, wherein said securement member is a cradle member with a semi-circular axle bearing housing portion adapted to be secured to an axle bearing housing of a rail car truck.

14. The mount apparatus of claim 12, wherein one end of said pivot arm is pivotably connected to said securement member by a bearing.

15. The mount apparatus of claim 12, wherein said lever arm of said pivot arm is an extension flange, and said swing arm is connected to a truck frame and said extension flange.

16. A mount apparatus for mounting a measurement device on a rail car above a track surface of a railroad track, the rail car having an unsprung component and a sprung component, said mount apparatus comprising:

a securement member adapted to be secured to the unsprung component of the rail car;

a pivot arm pivotably connected to said securement member, said pivot arm including a lever arm and a distal end that is cantilevered above the track surface of the railroad track; and a swing arm connecting said lever arm of said pivot arm to the sprung component of the rail car to rotate said pivot arm in a manner to move said distal end of said pivot arm a vertical distance that offsets a vertical distance moved by said sprung component relative to the unsprung component;

a cross bar laterally extending above said track surface, said cross bar being mounted at a distal end of said pivot arm.

17. A method for mounting a measurement device on a rail car, the rail car having an unsprung component and a sprung component, said method comprising the steps of:

securing said measurement device above a track surface of a railroad track in a cantilevered manner; and moving the position of said measurement device in response to movement of the sprung component relative to the unsprung component, thereby maintaining position of said measurement device secured in a cantilevered manner at a substantially the same fixed height distance above the track surface.

18. The method of claim 17, further including the step of securing said measurement device to a mounting apparatus and moving the position of said mounting apparatus in response to movement of the sprung component relative to the track surface, thereby moving the position of said measurement device.

19. The method of claim 18, wherein said mounting apparatus includes a securement member, a pivot arm with a lever arm extending therefrom, and a swing arm.

20. The method of claim 19, further including the steps of:

securing said securement member to the unsprung component of the rail car;

connecting said pivot arm to said securement member; and connecting said swing arm to said lever arm of said pivot arm and to the sprung component of the rail car, so that said pivot arm is rotated to move a distal end of said pivot arm a vertical distance that offsets a vertical distance moved by said sprung component relative to the track surface.

21. The method of claim 19, further including the step of adjusting the position of a distal end of said pivot arm based on an output of said measurement device.

* * * * *